US011805866B2

(12) United States Patent
Zeman

(10) Patent No.: US 11,805,866 B2
(45) Date of Patent: Nov. 7, 2023

(54) APPAREL CHARM CLIP

(71) Applicant: Katherine Zeman, Brooklyn Park, MN (US)

(72) Inventor: Katherine Zeman, Brooklyn Park, MN (US)

( * ) Notice: Subject to any disclaimer, the term of this patent is extended or adjusted under 35 U.S.C. 154(b) by 0 days.

(21) Appl. No.: 17/537,739

(22) Filed: Nov. 30, 2021

(65) Prior Publication Data

US 2022/0175095 A1 Jun. 9, 2022

Related U.S. Application Data

(60) Provisional application No. 63/120,861, filed on Dec. 3, 2020.

(51) Int. Cl.
*A44C 1/00* (2006.01)

(52) U.S. Cl.
CPC ..... *A44C 1/00* (2013.01)

(58) Field of Classification Search
CPC ..... A44C 1/00; A41D 27/08; Y10T 24/44521; Y10T 24/1391
See application file for complete search history.

(56) References Cited

U.S. PATENT DOCUMENTS 803,535 A * 10/1905 Mensor et al. ..... A41F 11/02 24/DIG. 22
867,655 A * 10/1907 Gutmann ..... A41F 11/02 24/504
926,401 A * 6/1909 Freedman ..... A45F 5/02 24/3.11
2,140,594 A * 12/1938 Placco ..... A44C 1/00 24/507
2,237,731 A * 4/1941 Freysinger ..... A41F 11/02 24/504
5,249,437 A * 10/1993 Cole, Jr. ..... A45C 1/06 63/12
6,386,408 B1 * 5/2002 Beatty ..... B60R 11/00 24/3.11
8,156,616 B2 * 4/2012 Lo ..... A45F 5/022 24/3.12
8,245,358 B2 * 8/2012 Lo ..... A61J 17/111 24/3.13
9,375,075 B2 * 6/2016 Bazan ..... A45F 5/021
9,439,476 B2 * 9/2016 Riccardi ..... A44C 25/007
9,993,063 B2 * 6/2018 Nowak ..... A45F 5/00
11,272,765 B2 * 3/2022 Corelli ..... A44C 15/001

* cited by examiner

*Primary Examiner* — Robert Sandy
*Assistant Examiner* — Louis A Mercado
(74) *Attorney, Agent, or Firm* — Brennan, Manna & Diamond, LLC

(57) ABSTRACT

The present disclosure relates to a decorative charm for attachment to clothing and apparel items. The decorative charm comes in different unique and decorative designs, used for accentuating clothing. More specifically, the decorative charm features a decorative surface that is positioned outside an apparel item and is visually exposed. A clip mechanism is used for attaching the charm to a rim or edge of an apparel item, and includes prong-like teeth that are positioned on opposite sides of the apparel edge and are operated using a clip arm. The clip arm is rotatable and is configured to create a space between the prong-like teeth to attach to an apparel item.

20 Claims, 7 Drawing Sheets

APPAREL CHARM CLIP

CROSS-REFERENCE TO RELATED APPLICATION

The present application claims priority to, and the benefit of, U.S. Provisional Application No. 63/120,861, which was filed on Dec. 3, 2020 and is incorporated herein by reference in its entirety.

FIELD OF THE INVENTION

The present invention relates generally to the field of accessories for clothes. More specifically, the present invention relates to an improved charm clip designed to be worn on apparel. The charm clip is a fully adjustable and decorative charm for fabric face masks and other types of clothing. The charm clip is a three-dimensional structure that attaches to clothing via an arm mechanism with integrated prong-like teeth. The charm clips can be available in numerous styles and designs, including animals logos, and much more, to fulfil the needs and requirements of different users. Accordingly, the present disclosure makes specific reference thereto. Nonetheless, it is to be appreciated that aspects of the present invention are also equally applicable to other like applications, devices and methods of manufacture.

BACKGROUND

As is well known in the fashion and apparel industry, individuals desire unique and trendy looks to add to their apparel. The apparel should match the latest fashion and trends. However, individuals can get bored and disappointed with the repeated and tired look of their clothes. This is also applicable to facemasks, that have become a part of fashion in addition to protecting a wearer from diseases. Conventional facemasks are plain, boring and may not appear appealing to individuals. The facemasks available in the market may lack a decorative or aesthetically-pleasing accessory. Individuals may desire to change their looks frequently. Changing looks by periodically buying new apparel and facemasks to have a new feel to their wardrobe can be expensive for users.

To complement and enhance the looks of standard clothes and facemasks, various kinds of accessories and jewelry are available in the market that can be easily worn with the clothes. For example, accessories such as clips, lapel pins, tie pins and the like are generally attached to different clothes, face masks and more to enhance the look of the clothing. However, standard clips and pins can be uncomfortable to wear, and can injure the wearer if the pin is inserted through the clothing or face masks. In case the pin opens inadvertently, the wearer may be injured, causing pain for the user. Also, standard clips and pins comprising pin-based structures may not be easy to wear by the individuals. As such, individuals may seek out other accessories to decorate their clothing that can be conveniently worn by the individuals.

Therefore, there exists a long felt need in the art for an accessory that can be worn with clothing, face masks and hats. There is also a long felt need in the art for an accessory that enhances and modifies the look of clothing, face masks and hats. Additionally, there is a long felt need in the art for an accessory that ensures the clothing, face masks and hats are not plain and boring for the users. Moreover, there is a long felt need in the art for an accessory that is decorative and aesthetically appealing, and helps in quickly changing the look of the clothes/face masks/hats. Further, there is a long felt need in the art for an accessory that does not require users to frequently buy new clothes and facemasks to get unique looks from the apparel. Furthermore, there is a long felt need in the art for an accessory that does not include a pin structure, and can be easily worn by the users. Additionally, there is a long felt need in the art for an accessory that is not risky to wear and does not injure the wearer. Finally, there is a long felt need in the art for an accessory that offers a fun, inspiring and safe way to decorate clothing.

The subject matter disclosed and claimed herein, in one potential embodiment thereof, comprises an apparel item charm clip for attachment to an apparel item or an apparel item accessory. The apparel charm clip comprises: a front surface that includes a customized design; a rear surface to which a clip mechanism is attached, wherein the clip mechanism is configured to attach the apparel charm clip to a rim or edge of an apparel item; the clip mechanism includes a clip arm hingedly-connected to a connecting arm; a pair of prongs including a plurality of teeth attached to the connecting arm; the clip arm and one of the prongs are coupled using a torsional spring; and one of the prongs moves (i.e. opens) to create a space between the pair of prongs when the clip arm is rotated, enabling the charm clip to be securely fastened to the rim or edge of the apparel. The clip mechanism also includes a rotating circular member that enables the clip mechanism to rotate in a desired orientation.

In this manner, the novel apparel charm clip of the present invention accomplishes all of the forgoing objectives, and provides a relatively safe, easy and convenient solution to attach to standard clothing and facemasks in order to enhance their looks. The apparel charm clip of the present invention is also user friendly, as it eliminates the need to periodically buy new clothes and facemasks to obtain a unique appearance, and therefore saves money for the users. Additionally, the apparel charm clip can be conveniently worn by the individuals and is safe to use.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one potential embodiment thereof, comprises an apparel item charm clip for attachment to an apparel item or an apparel item accessory. The apparel charm clip further comprises: a front surface that has a customized design; a rear surface to which a clip mechanism is attached, wherein the clip mechanism is configured to attach the apparel charm clip to rim or edge of an apparel item; the clip mechanism includes a clip arm hingedly-connected to a connecting arm; a pair of prongs including a plurality of teeth attached to the connecting arm; the clip arm and one of the prongs are coupled using a torsional spring; and, one of the prongs moves (i.e. opens) to create a space between the pair of prongs when the clip arm is rotated, enabling the charm clip to be securely fastened to the rim or edge of the apparel. The clip mechanism also includes a rotating circular member that enables the clip mechanism to rotate in a desired orientation.

In yet another potential embodiment of the present invention, a method of attaching a charm clip to an apparel item is disclosed. The method includes: providing the charm clip; pulling a clip arm away from a connecting arm when the clip arm is pulled away; moving a first prong away from a second prong, enabling a space to be created therebetween; inserting the first prong and the clip arm inside the apparel; positioning the second prong and the customized charm surface outside the apparel, wherein the apparel lies in the created space; and releasing the clip arm to fasten the charm clip to the apparel.

In yet another potential embodiment of the present invention, the method further includes rotating a connecting member to re-position the charm clip to a desired position or orientation.

In yet another potential embodiment, the charm clip can have a 2D or 3D front surface or decorative surface. The front surface can have any customized shape which is visually exposed and positioned outside the apparel.

In yet another potential embodiment, the clip arm can be enclosed in latex-free, rubber-like substances to protect the wearer's skin from irritation. The charms can be attached to a rim or edge of any clothing, bag, purse, belt, hat brim/bill/visor or the like.

In yet another potential embodiment of the present invention, a decorative charm for attachment to an apparel item is disclosed. The decorative charm includes: a front surface that is decorative; a rear surface that has an attachment mechanism to clip the decorative charm to a rim or edge of the apparel; the front surface can be made of a soft and flexible material; and the attachment mechanism includes prong teeth that are positioned on opposite sides of the rim or edge of the apparel to fasten the charm thereto.

In yet another potential embodiment of the present invention, a method of mounting a charm to an apparel item is described. The method comprises: positioning a front side of the charm on the outside of the apparel; positioning a clip arm inside the apparel; pulling the clip arm to position a pair of prongs on opposite sides of the apparel material; and releasing the clip arm to fasten the charm to the apparel.

The advantage of the charms of the present invention is that they are capable of being attached to face masks, hats, shirts and other clothing apparel. The charms offer several different unique and decorative designs that can be used to accentuate clothing and express individuality.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed, and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
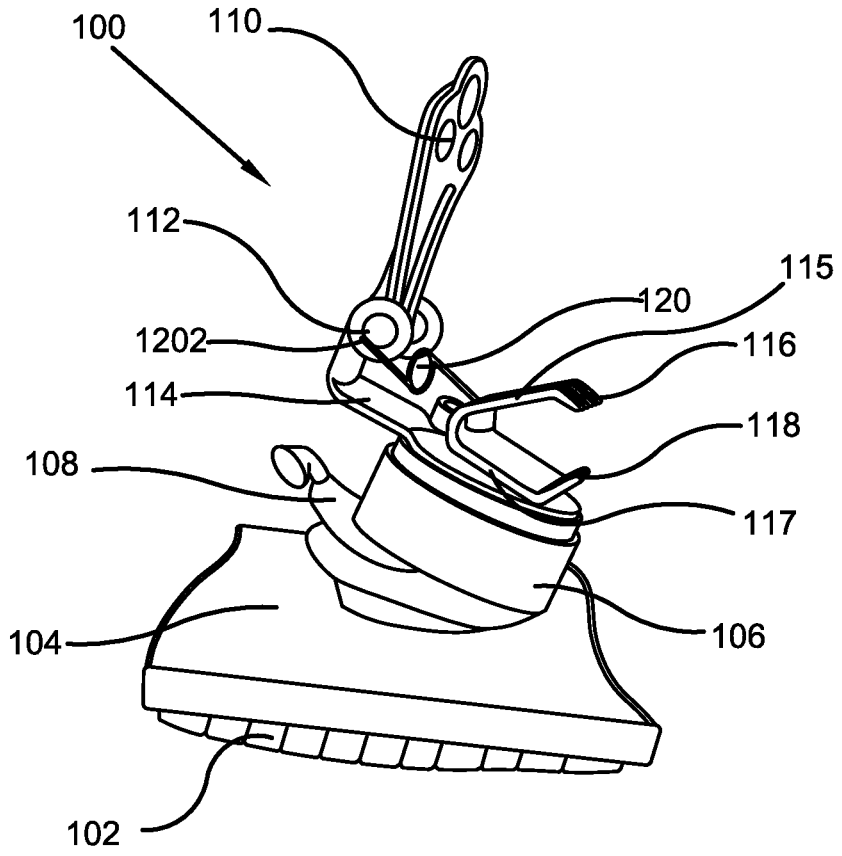
FIG. 1 illustrates a perspective view of one potential embodiment of an apparel item charm clip of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for an accessory that can be worn with clothing, face masks and hats. There is also a long felt need in the art for an accessory that enhances and modifies the looks of clothing, face masks and hats with which it is worn. Additionally, there is a long felt need in the art for an accessory that ensures the clothing, face masks and hats do not remain plain and boring for the users. Moreover, there is a long felt need in the art for an accessory that is decorative and aesthetically appealing, and helps in quickly changing the look of the clothes/facemasks/hats. Further, there is a long felt need in the art for an accessory that does not require users to frequently buy new clothes and facemasks to get unique looks from the apparel. Furthermore, there is a long felt need in the art for an accessory that does not include a pin structure and can be easily worn by the users. Additionally, there is a long felt need in the art for an accessory that is not risky to wear and does not injure the wearer. Finally, there is a long felt need in the art for an accessory that offers a fun, safe and inspiring way to decorate clothing.

The present invention, in one exemplary embodiment, includes a novel decorative charm for attachment to an apparel item. The decorative charm includes a front surface that is decorative, and a rear surface that includes an attachment mechanism to clip the decorative charm to a rim or an edge of an apparel item. The front surface of the clip can be made of a soft and flexible material. Additionally, the attachment mechanism of the clip includes prongs with teeth that are positioned on opposite sides of the rim of the apparel to fasten the charm to the apparel. The structure of the clip ensures the charm can be easily worn by the individuals and does not injure them as well.

Referring initially to the drawings, FIG. 1 illustrates a perspective view of one potential embodiment of an apparel item charm clip of the present invention in accordance with the disclosed architecture. The apparel charm clip 100 of the present embodiment includes an adjustable and/or rotatable charm that can attach to an apparel item via an arm mechanism with prong-like teeth. More specifically, the charm clip 100 includes a front surface 102 that includes a custom design in 2-D or 3-D format. The front surface 102 is visible to other users, and is positioned outside an apparel item to which the charm clip 100 is attached. The front surface 102 accentuates and decorates the apparel and clothing. The front surface 102 comes in multiple colors and can be made of silicone, rubber, latex or any other soft and flexible material. The front surface 102 can also be provided with one or more decorative elements, such as gems, crystals, icons, emblems or the like. A rear surface 104 of the charm clip 100 can be attached to the front surface 102 through an adhesive. Further, the rear surface 104 includes a connector 108 positioned substantially at the center of the rear surface 104. Through the connector 108, a clip mechanism for clipping or mounting the charm clip 100 to an apparel item is attached to the rear surface 104. The clip mechanism includes a rotating circular member 106 that is configured to rotate in both clockwise and counter-clockwise directions. One of the objectives of the rotating circular member 106 is that the clip mechanism can be rotated to position the charm, as per the desires and needs of a user.

The clip mechanism further includes a hinged clip arm 110 connected via a hinged pin 112 to a connecting arm 114. The connecting arm 114 includes an integrated pair of prong arms 115, 117, including teeth at the distal or terminal ends 116, 118. A first prong arm 115 is configured to move when the hinged clip arm 110 is rotated. More specifically, the first prong arm 115 and distal prong teeth 116 are connected to the hinged clip arm 110 through a torsional spring 120 that enables the first prong arm 115 and prong teeth 116 to move up and away from the second prong arm 117, when the hinged clip arm 110 is rotated away from the connecting arm 114, thus, creating a space between the prong teeth 116, 118 to attach the charm clip 100 to an apparel item. It should be noted that the hinged clip arm 110 can rotate up to a ninety-degree angle, relative to the connecting arm 114 using the hinged pin 112. Once the charm clip 100 is attached to an apparel item, the clip arm 110 can be released, wherein the spring 120 applies a biasing and restoring force to rotate the first prong arm 115 back towards the connecting arm 114 and thus, closes the gap between the prong arms 115, 117 and prong teeth 116, 118 for secure attachment to the apparel.

The prong arms 115, 117 and prong teeth 116, 118 form a generally triangular shape such that the prong teeth 116 are inserted under an apparel item, and the prong teeth 118 are positioned above or outside the apparel to secure the clip 100 to the apparel between the prong teeth 116, 118.

All the components described supra regarding the clip mechanism are relatively small and durable, enabling the charm clip 100 to attach to any kind of apparel or accessory such as a facemask, cap, hat, scarf or the like. The orientation of the prong teeth 116, 118 and the clip arm 110 can be changed using the rotating circular member 106, enabling the charm clip 100 to be clipped to any apparel item in any orientation relative thereto. The aforementioned rotation provides an advantage over conventional charms that are attached only in a specific orientation. The clip arm 110, the prong arms 115, 117, the prong teeth 116, 118 and the rotating member 106 can be include a material selected from a group consisting of a metal, a stainless steel, a plastic and a glass. The clip arm 110 can be specifically coated with a latex-free rubber-like substance to protect a wearer's skin from irritation.

The prong arms 115, 117 and prong teeth 116, 118 assist in the fastening of the charm clip 100 to a fashion item and prevent slippage. Similarly, a torsional spring 120 can be utilized to couple the clip arm 110, prong arms 115, 117 and prong teeth 116, 118 to fasten the charm clip 100 to a fashion item.

In another exemplary aspect, the charm clip 100 as described herein can be utilized in conjunction with various types of garments, such as t-shirts, shirts, pants, dresses, etc. Further, the charm clip 100 can be utilized with clothing accessories in a supplemental manner, such as with a facemask, purse, belt, cap, etc.

Figure 2:
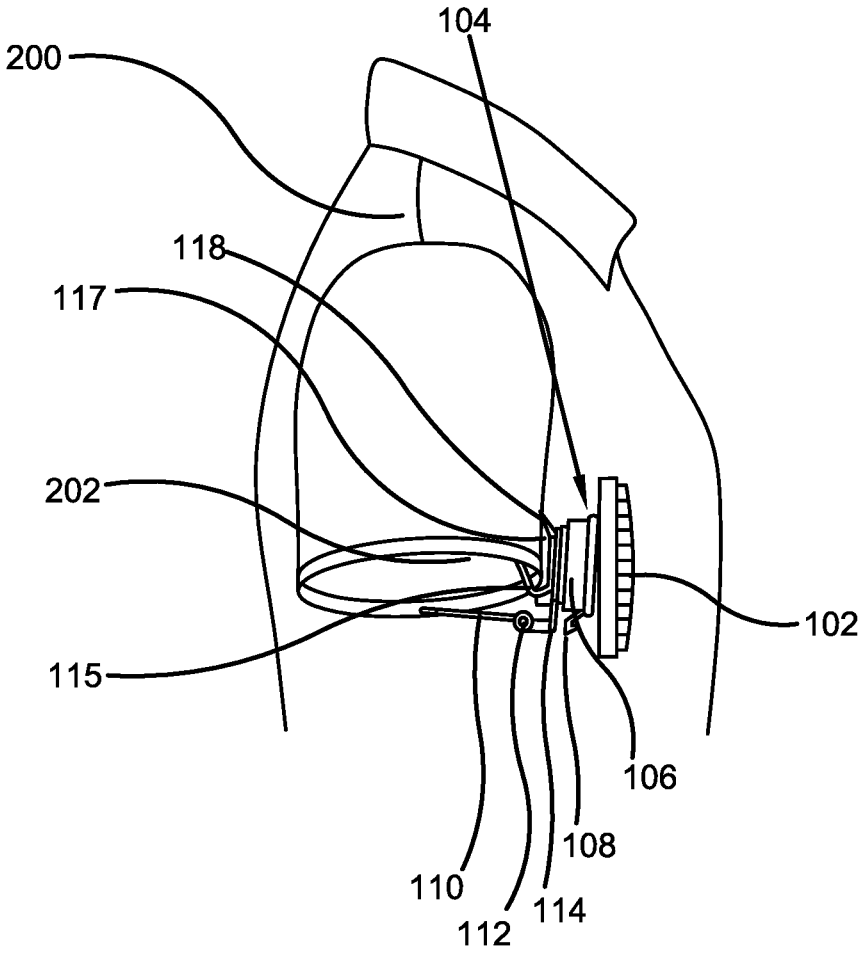
FIG. 2 illustrates a perspective view showing the charm clip of FIG. 1 attached to a sleeve of a t-shirt in accordance with the disclosed architecture.

FIG. 2 illustrates a perspective view showing the charm clip 100 of FIG. 1 attached to a sleeve of a t-shirt, in accordance with the disclosed architecture. When attached to an apparel item such as sleeve 202 of a t-shirt 200, the front surface 102 including the design is positioned outside the sleeve 202, such that the front surface 102 is easily visible to others and provides a designer look to the t-shirt 200. The second prong teeth 118 are positioned outside the sleeve 202 and the first prong teeth 116 are positioned inside the sleeve 202, while the clip arm 110 is also positioned inside the sleeve 202. It is to be appreciated that the size of the front surface 102 is large enough to hide the components of the clip mechanism positioned outside the sleeve 202. Using the connector 108 and the rotating circular member 106, the front surface 102 can be rotated and adjusted as per the desire of the user.

For attaching the charm clip 100 to the sleeve 202, the clip arm 110 can be pulled or hinged away from the connecting arm 114, so that the prong teeth 116, 118 create an opening when the first prong teeth 116 are moved away from the second prong teeth 118. The clip arm 110 can be pulled away or pivoted along the hinged pin 112. A portion of the apparel can be secured in an opening created between the first prong teeth 116 and the second prong teeth 118, when the clip arm 110 is released or biased towards the connecting arm 114 to close the opening between the prong teeth 116, 118 to secure the charm clip 100 to the apparel, such as a sleeve 202 of the t-shirt 200. Preferably, the charm clip 100 is attached to the rim or edge portion of an apparel item with the rim or edge secured between the prong teeth 116, 118.

Figure 3:
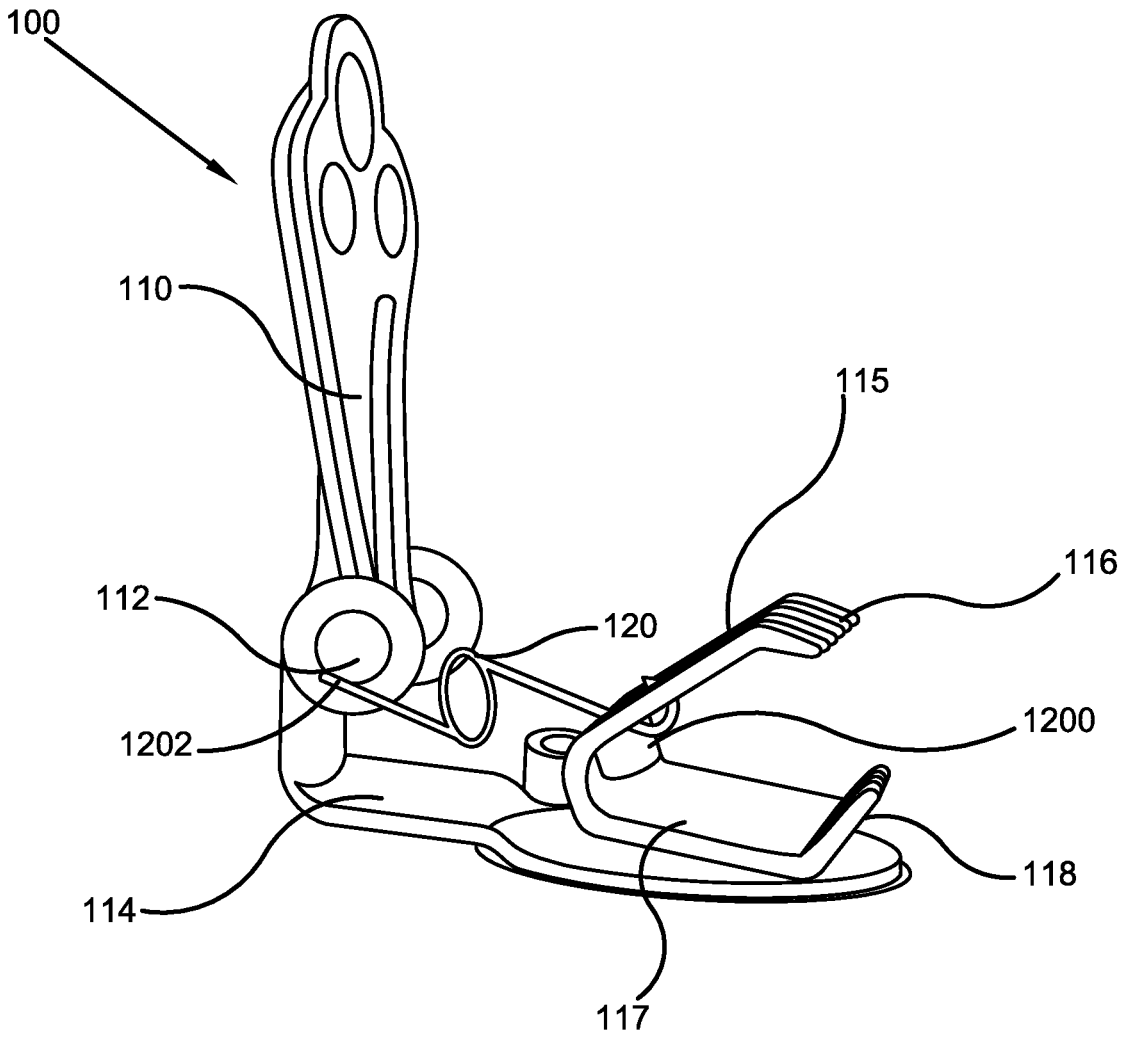
FIG. 3 illustrates an enlarged view of the coupling mechanism of the clip arm and the spring actuated prongs using a torsional spring for enabling movement of the prongs upon rotating the clip arm in accordance with the disclosed architecture.

FIG. 3 illustrates an enlarged view of the coupling of the clip arm 110, prong arm 115, and prong teeth 116 using torsional spring 120 for enabling movement of the prong arm 115 and prong teeth 116 on rotating the clip arm 110 in accordance with the disclosed architecture. The clip arm 110 is connected to the first prong arm 115, using a torsional spring 120. A first end 1200 of the spring 120 is connected to the first prong arm 115, and the second end 1202 is connected to the hinge of clip arm 110. When the clip arm 110 is rotated away from the connecting arm 114, the first end 1200 of the spring 120 applies a force on the first prong arm 115 making the first prong teeth 116 move away from the second prong teeth 118, thus enabling space to be created between the prong teeth 116, 118 to fasten to an apparel item. When the clip arm 110 is released, the first end 1200 releases the applied force, enabling the first prong teeth 116 and the second prong teeth 118 to bias towards each other to close the opening/gap.

Figure 4:
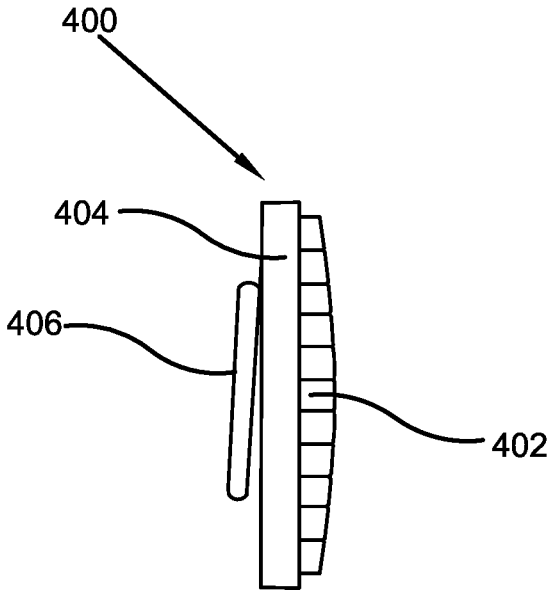
FIG. 4 illustrates a perspective view showing another potential embodiment of the charm clip of the present invention in accordance with the disclosed architecture.

FIG. 4 illustrates a perspective view showing another potential embodiment of the charm clip of the present invention in accordance with the disclosed architecture. In the present embodiment of the charm clip 400, the front surface 402 is permanently attached to the rear surface 404. The front surface 402 and the rear surface 404 can be separate surfaces, or can be opposite surfaces of a single layer of soft and flexible material. In the present embodiment, the rear surface 404 includes an adhesive layer 406 that can be selectively-attached to any fabric, leather or any material with which conventional clothing is typically made. To attach or fasten the charm clip 400 to an apparel item, a protective layer (not illustrated) adhering to the adhesive layer 406 can be removed. The adhesive layer 406 can then be attached to the apparel at the desired position. The adhesive fastens the charm clip 400 to the apparel, and can be subsequently removed by pulling the charm clip 400 using the flexible front surface 402. The adhesive layer 406 is reusable and can be fastened and removed multiple times as per the desires and preferences of a user.

Figure 5:
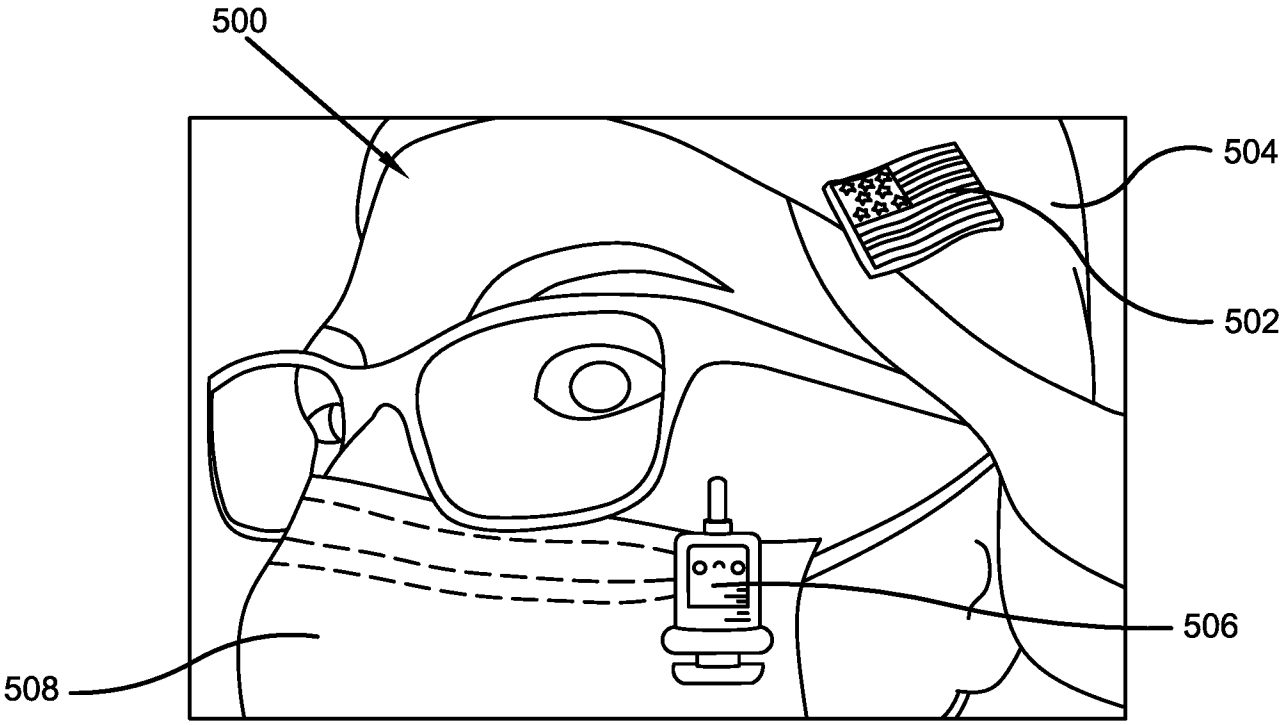
FIG. 5 illustrates a perspective view showing a user using multiple embodiments of the charm clip of the present invention in accordance with the disclosed architecture.

FIG. 5 illustrates a perspective view showing a user using multiple embodiments of the charm clip of the present invention in accordance with the disclosed architecture. A user 500 is wearing a flag-shaped charm clip 502 attached on a cap 504, and a syringe-shaped charm clip 506 attached on a facemask 508. Both the flag charm clip 502 and the syringe charm clip 506 are flexible, soft and multicolored. The charm clips 502, 506 can have the clip fastening mechanism or adhesive fastening mechanism as described supra in the disclosure. It should be appreciated that the charm clips of various embodiments of the present invention are attached along the rim or edge of an apparel item.

Figure 6:
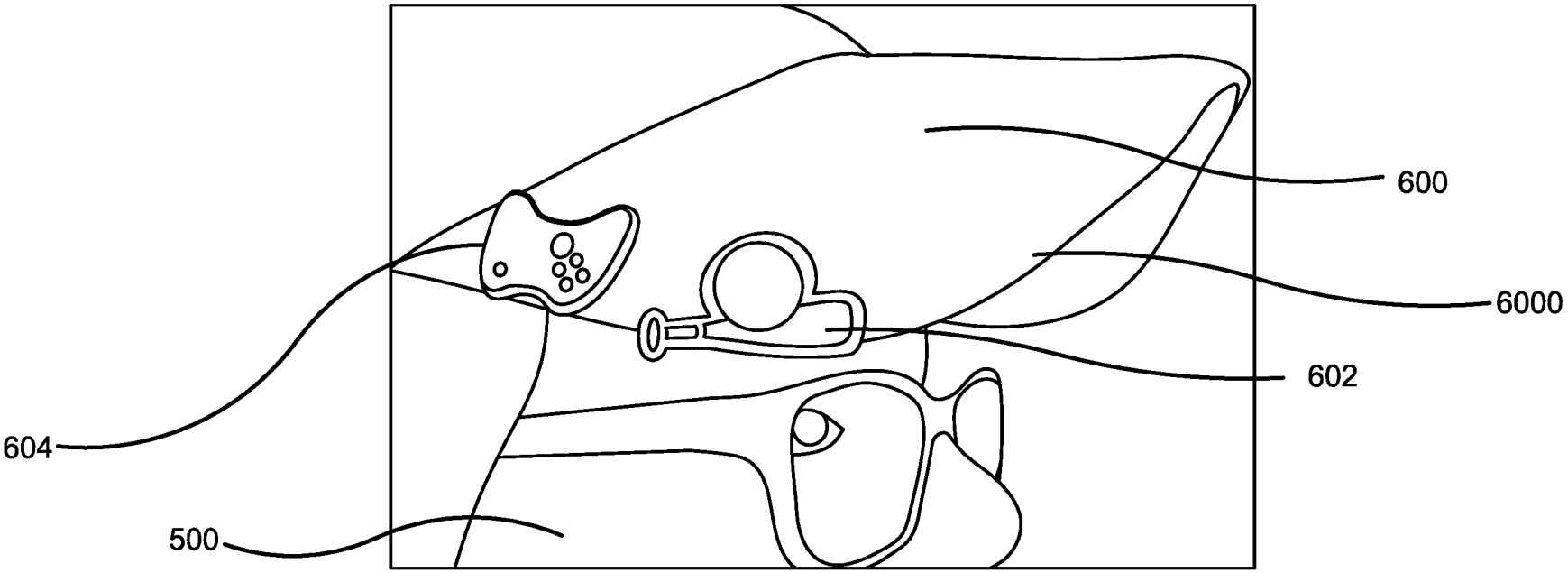
FIG. 6 illustrates a perspective view showing a user using additional embodiments of the charm clip of the present invention in accordance with the disclosed architecture.

FIG. 6 illustrates a perspective view showing a user using additional embodiments of the charm clip of the present invention in accordance with the disclosed architecture. The user 500 is wearing a baseball-shaped charm clip 602 attached to the rim 6000 of the cap 600, and also a game controller-shaped charm clip 604 attached to the rim 6000. Both the baseball-shaped charm clip 602 and the game controller-shaped charm clip 604 are flexible, soft and configured in multiple colors. The charm clips 602, 604 can have the clip fastening mechanism or adhesive fastening mechanism as described earlier in the disclosure.

Figure 7:
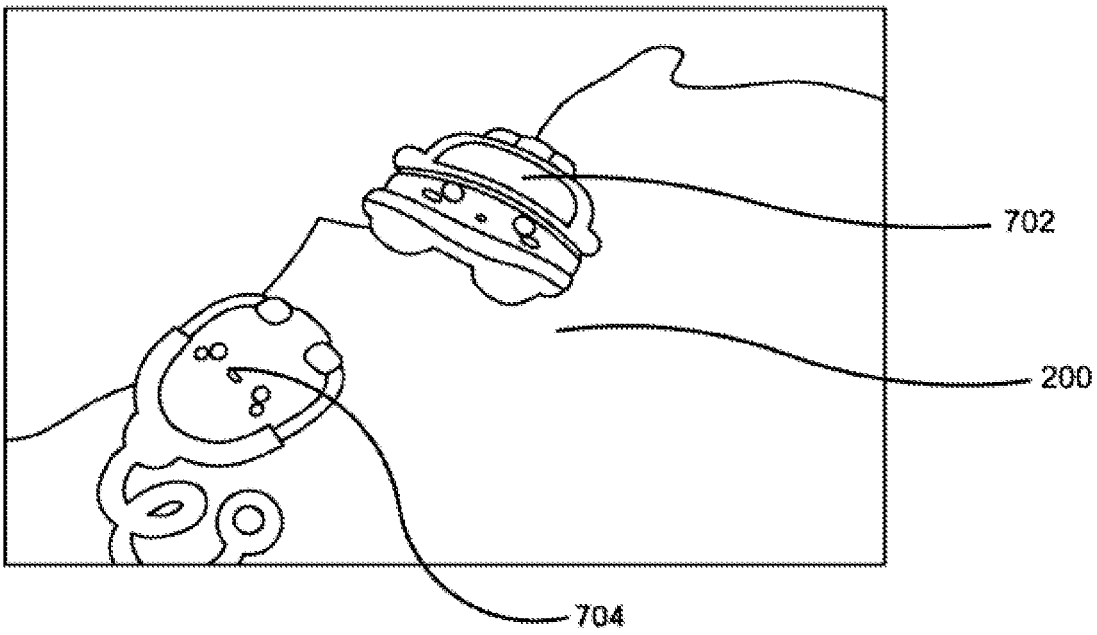
FIG. 7 illustrates a perspective view showing more embodiments of the charm clip of the present invention in accordance with the disclosed architecture.

FIG. 7 illustrates a perspective view showing more embodiments of the charm clip of the present invention in accordance with the disclosed architecture. In the present embodiment, a doctor charm clip 702 attached to rim or edge of the t-shirt 200, and also a stethoscope-shaped charm clip 704 attached to the t-shirt 200. Both the doctor charm clip 702 and the stethoscope-shaped charm clip 704 are flexible, soft and configured in multiple colors. The charm clips 702, 704 can have the clip fastening mechanism or adhesive fastening mechanism as described earlier in the disclosure.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "charm clip", "apparel charm clip", "decorative charm", "improved apparel charm clip", and "charm", are interchangeable and refer to the apparel charm clip 100, 400 of the present invention.

Notwithstanding the forgoing, the apparel charm clip 100, 400 of the present invention can be of any suitable size and configuration as is known in the art without affecting the overall concept of the invention, provided that it accomplishes the above-stated objectives. One of ordinary skill in the art will appreciate that the size, configuration and material of the apparel charm clip 100, 400 as shown in the FIGS. are for illustrative purposes only, and that many other sizes and shapes of the apparel charm clip 100, 400 are well within the scope of the present disclosure. Although the dimensions of the apparel charm clip 100, 400 are important design parameters for user convenience, the apparel charm clip 100, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments including different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparel item charm clip comprising:

a rotatable charm including a front surface and a rear mount;

said rear mount includes a clip mechanism attached to said rear mount;

said clip mechanism includes a rotating member configured to rotate said front surface in both clockwise and counterclockwise directions to position said front surface in a desired orientation;

said clip mechanism further includes a hinged clip arm connected to a hinged pin and a connecting arm;

said connecting arm includes a first prong arm having teeth at a first terminal end and a second prong arm having teeth at a second terminal end;

a torsional spring connecting and biasing said hinged clip arm and said first prong arm;

a spring biasing force overcome by rotating said hinged clip arm to open said first prong arm and said second prong arm to mount said charm clip to an edge of an apparel item; and said spring biasing force restoring said first prong arm and said second prong arm to a closed orientation to attach said charm clip to said apparel item.

2. The apparel item charm clip of claim 1, wherein said hinged clip arm includes a latex-free rubber coating.

3. The apparel item charm clip of claim 2, wherein said front surface includes a 3-D design having a material selected from a group consisting of a silicone, a rubber, and a latex.

4. The apparel item charm clip of claim 3, wherein said 3-D design includes a decorative element selected from a group consisting of a gem, a crystal, an icon, and an emblem.

5. The apparel item charm clip of claim 2, wherein said front surface includes a 2-D design.

6. An apparel item charm clip comprising:

a rotatable charm including a front surface and a rear mount;

said rear mount includes a clip mechanism attached to said rear mount;

said clip mechanism includes a rotating member configured to rotate said front surface in both clockwise and counterclockwise directions to position said front surface in a desired orientation;

said clip mechanism further includes a hinged clip arm connected to a hinged pin and a connecting arm;

said connecting arm includes a first prong arm having teeth at a first terminal end and a second prong arm having teeth at a second terminal end;

a torsional spring having a first end connected to said first prong arm and a second end connected to said hinged clip arm for biasing and restoring said hinged clip arm and said first prong arm to a closed orientation;

a spring biasing force overcome by rotating said hinged clip arm to open said first prong arm and said second prong arm to mount said charm clip to an edge of an apparel item; and said front surface includes a 3-D design having a material selected from a group consisting of a silicone, a rubber, and a latex.

7. The apparel item charm clip of claim 6, wherein said hinged clip arm includes a latex-free rubber coating.

8. The apparel item charm clip of claim 7, wherein said spring biasing force restoring said first prong arm and said second prong arm to said closed orientation to attach said charm clip to said apparel item.

9. The apparel item charm clip of claim 8, wherein said 3-D design includes a decorative element selected from a group consisting of a gem, a crystal, an icon, and an emblem.

10. An apparel item charm clip comprising:

a rotatable charm including a front surface and a rear mount;

said rear mount includes a clip mechanism attached to said rear mount;

said clip mechanism includes a rotating member configured to rotate said front surface in both clockwise and counterclockwise directions to position said front surface in a desired orientation;

said clip mechanism further includes a hinged clip arm connected to a hinged pin and a connecting arm;

said connecting arm includes a first prong arm having teeth at a first terminal end and a second prong arm having teeth at a second terminal end;

a torsional spring having a first end connected to said first prong arm and a second end connected to said hinged clip arm for biasing and restoring said hinged clip arm and said first prong arm to a closed orientation;

a spring biasing force overcome by rotating said hinged clip arm to open said first prong arm and said second prong arm to mount said charm clip to an edge of an apparel item;

said first terminal end, said first prong arm, said second prong arm, and said second terminal end forming a generally triangular shape, wherein said first prong arm is inserted under said edge of the apparel item and said second prong arm is outside said edge of the apparel item to secure said charm clip to said edge of the apparel item; and said front surface includes a design.

11. The apparel item charm clip of claim 10, wherein rotating of said hinged clip arm includes a rotation of up to a ninety-degree angle relative to said connecting arm.

12. The apparel item charm clip of claim 10, wherein said front surface includes a 3-D design having a material selected from a group consisting of a silicone, a rubber, and a latex.

13. The apparel item charm clip of claim 10, wherein said hinged clip arm includes a latex-free rubber coating.

14. The apparel item charm clip of claim 13, wherein said apparel item is selected from a group consisting of a facemask, a cap, and a hat.

15. The apparel item charm clip of claim 10, wherein said front surface includes a 3-D design having a material selected from a group consisting of a metal, a stainless steel, a plastic, and a glass.

16. The apparel item charm clip of claim 10, wherein said front surface includes a 2-D design.

17. The apparel item charm clip of claim 16, wherein said 2-D design includes a material selected from a group consisting of a silicone, a rubber, and a latex.

18. The apparel item charm clip of claim 17, wherein said 2-D design includes a decorative element selected from a group consisting of a gem, a crystal, an icon, and an emblem.

19. The apparel item charm clip of claim 18, wherein said apparel item is selected from a group consisting of a facemask, a cap, and a hat.

20. The apparel item charm clip of claim 16, wherein said 2-D design includes a material selected from a group consisting of a metal, a stainless steel, a plastic, and a glass.

* * * * *